US005526775A

United States Patent [19]

Hyppänen

[11] Patent Number: 5,526,775

[45] Date of Patent: Jun. 18, 1996

[54] CIRCULATING FLUIDIZED BED REACTOR AND METHOD OF OPERATING THE SAME

[75] Inventor: Timo Hyppänen, Karhula, Finland

[73] Assignee: Foster Wheeler Energia Oy, Karhula, Finland

[21] Appl. No.: 321,690

[22] Filed: Oct. 12, 1994

[51] Int. Cl.[6] ..... F22B 37/10

[52] U.S. Cl. ..... 122/235.11; 122/4 D; 122/4 R; 122/235.12; 122/488; 110/245

[58] Field of Search ..... 122/4 D, 4 R, 122/235.11, 235.12, 488; 110/245

[56] References Cited

U.S. PATENT DOCUMENTS

| | | |
|---|---|---|
| 4,363,292 | 12/1982 | Engstrom . |
| 4,442,796 | 4/1984 | Strohmeyer, Jr. . |
| 4,548,138 | 10/1985 | Korenberg . |
| 4,716,856 | 1/1988 | Beisswenger et al. . |
| 4,793,292 | 12/1988 | Engstrom et al. . |
| 4,828,486 | 5/1989 | Sakamoto et al. . |
| 4,896,717 | 1/1990 | Campbell, Jr. et al. . |
| 5,060,599 | 10/1991 | Chambert . |
| 5,069,170 | 12/1991 | Gorzegno et al. . |
| 5,069,171 | 12/1991 | Hansen et al. . |

*Primary Examiner*—Henry A. Bennett
*Assistant Examiner*—Siddharth Ohri
*Attorney, Agent, or Firm*—Nixon & Vanderhye

[57] ABSTRACT

A circulating fluidized bed reactor has substantially vertical walls with cooling elements, defining the interior of the reactor chamber, and a device for introducing fluidization gas at the bottom of the fluidized bed reactor. Particulate material is introduced into the reactor. A separator separates particulate material from the exhaust gases, the separator being in connection with the reactor chamber. A return duct is connected to the separator. A bubbling fluidized bed is adjacent the reactor and provided with a heat exchanger for cooling particulate material, and side walls, rear and front walls having cooling elements in fluid communication with the cooling elements of the reactor chamber; and a discharge channel with a separate fluidizing gas source for discharging particles from the bottom of the bubbling bed to adjacent the top of the bubbling bed in the reactor chamber. A method of operating a circulating fluidized bed reactor, comprises the steps of maintaining a circulating fluidized bed in the reactor; separating particulate material from the gas in the separator and returning separated material back to the reactor; introducing particulate material into the bubbling fluidized bed above the upper surface of the bubbling fluidized bed; fluidizing the particulate material in the bubbling fluidized bed and recovering heat from the fluidized particulate material by the heat exchanger; discharging cooled particulate material from the bubbling fluidized bed at its lower section into the lower section of the discharge channel; fluidizing the discharged particulate material in the discharge channel; and introducing particulate material from the upper section of the discharge channel into the reactor chamber.

20 Claims, 7 Drawing Sheets

CIRCULATING FLUIDIZED BED REACTOR AND METHOD OF OPERATING THE SAME

BACKGROUND AND SUMMARY OF THE INVENTION

The present invention relates to a circulating fluidized bed reactor and method of operating the circulating fluidized bed reactor. The present invention also relates to a wall structure of a circulating fluidized bed reactor. More specifically, the invention relates to a circulating fluidized bed reactor having substantially vertical walls with cooling elements therein, the vertical walls defining the interior of the reactor chamber; means for introducing fluidization gas at the bottom of the fluidized bed reactor; means for introducing particulate material into said reactor, separator for separating particulate material from the gases, the separator being in connection with said reactor at the upper section thereof; return duct, being connected to the separator; bubbling fluidized bed adjacent to the reactor and being provided with heat exchanger means for cooling particulate material, side walls, and rear and front walls having cooling elements in fluid communication with the cooling elements of the reactor, said bubbling fluidized bed being connected with said return duct.

The present invention also relates to a method of operating a circulating fluidized bed reactor having substantially vertical walls with cooling elements therein, the vertical walls defining the interior of the reactor chamber; means for introducing fluidization gas at the bottom of the fluidized bed reactor; means for introducing particulate material into said reactor; separator for separating particulate material from the gases, the separator being in connection with said reactor at the upper section thereof; bubbling fluidized bed adjacent to the reactor and being provided with heat exchanger means for cooling particulate material, side walls, and rear and front walls having cooling elements in fluid communication with the cooling elements of the reactor, a discharge channel between said heat exchanger and rear wall; the method comprising the steps of maintaining a circulating fluidized bed in the reactor by providing entrainment of a substantial amount of particulate material from the reactor to the separator; separating particulate material from the gas in the separator and returning separated material back to the reactor; introducing particulate material into the bubbling fluidized bed above the upper surface of bubbling fluidized bed; fluidizing the particulate material in the bubbling fluidized bed and recovering heat from the fluidized particulate material by said heat exchanger; discharging the cooled particulate material from said bubbling fluidized bed from the lower section thereof into the lower section of a discharge channel; fluidizing said discharged particulate material in said discharge channel and introducing the particulate material from the upper section of said discharge channel into the reactor.

U.S. Pat. No. 5,060,599 shows a circulating fluidized bed reactor having pockets formed in the side wall thereof to receive material flowing downwardly along the wall. The pocket is provided with an upward opening at a location where the density of the fluidized bed is considerably lower than that adjacent to the reactor bottom. This document shows how to control the material flow by allowing the material to outflow over the edge of the pocket or by discharging material via a duct or opening in the bottom of the pocket. The pocket is formed inside the reactor by providing a partition wall in the reaction chamber. To have a sufficient volume for the pocket and heat transfers therein the partition wall must be considerably high. A heavy wall structure of this kind is very difficult as it causes stresses to other structures at its joining points and also undesirable vibration of structures. If the height of the partition wall is increased, the operation of such a pocket will be restricted to merely high load operations. At low loads, insufficient amounts of solid material will be falling into the pocket. Also, since the pocket may be emptied directly via the opening at its bottom, there must be some additional means for controlling the discharge of the material and for preventing any accidental discharge thereof.

U.S. Pat. No. 4,716,856 shows an integral fluidized bed heat exchanger in an energy producing plant. There is shown an integral fluidized bed heat exchanger and fluidized bed reactor having a common wall between them. The common wall is provided with openings for allowing the material from the fluidized bed heat exchanger to overflow into the reactor. As disclosed, there must be separate controlling facilities and a recycle leg for directing the surplus material separated from the gases directly back to the reactor. This arrangement has only one level from which the material overflows to the reactor. The gases and particles flow through the same opening.

In U.S. Pat. No. 4,896,717 there is shown a fluidized bed reactor in which a recycle heat exchanger is located adjacent to the furnace of the reactor with each enclosing a fluidized bed and sharing a common wall which includes a plurality of water tubes. In this document, the solids are also suggested to overflow back to the reactor. However, this document suggests to direct all separated material via the recycle heat exchanger back to the reactor. This results in that the capacity of the recycle heat exchanger must such as to allow the material to flow even at a maximum load, which easily leads to an unnecessarily large and over-dimensioned construction with regard to the performance of the heat exchanger. Also, the fluidization gas of the recycle heat exchanger must be conveyed via the overflow opening and further downwardly in the passage to the reactor.

U.S. Pat. Nos. 5,069,170 and 5,069,171 show also integral recycle heat exchangers in connection with a circulating fluidized bed reactor. Those, however, apply several compartments in the external heat exchanger chamber to manipulate the solids flow. The initial principle of introducing solid material from the bed to the reactor is also an overflow of material. These solutions are somewhat complicated.

In EP publication 0 550 932 there is shown a system for cooling hot particulate material from a fluidized bed reactor having three distinct fluidized beds in an external, separate fluidized bed cooler. The material entrained with the gases is separated from the exhaust gases and is directed to a first fluidized bed from which the material is facultatively directed either to a second fluidized bed or a discharge duct. The second and a third fluidized bed cooler are located adjacently, below the first fluidized bed being divided by a common wall and communicating with their lower and upper sections. There is a gas space above the second and the third fluidized bed coolers and below the first fluidized bed to collect and pass the gas and solids to the common discharge duct connecting the fluidized bed cooler with the reactor. In this arrangement, it is difficult to efficiently control the flow of solids due to the general layout. It is also highly potential that a short circuit of hot solids is formed, i.e., solids flow easily uncooled from the first fluidized bed directly to the discharge duct.

U.S. Pat. No. 4,363,292 discloses an arrangement for providing heat transfer sections on the bottom grid of a fluidized bed reactor. In this system, there are also partition walls above the grid which divide the bottom section of the reactor into several sections. This arrangement has also a limited capability to provide sufficiently of heat transfer surface in the heat transfer section, particularly for low load conditions. This and other known methods of operating a fluidized bed reactor still have shortcomings which the present invention aims to abolish.

It is an object of the present invention to provide a circulating fluidized bed with an integrated compact heat exchanger, which solves the problems of the prior art.

It is a further object of the present invention to provide a circulating fluidized bed with an integrated compact heat exchanger, which efficiently complies with the demands on the heat exchange rate.

It is still a further object of the present invention to provide a wall structure partitioning the integrated compact heat exchanger and the circulating fluidized bed reactor.

It is still a further object of the present invention to provide a wall structure partitioning the integrated compact heat exchanger and the circulating fluidized bed reactor, which may be utilized as a part of a particulate material discharge channel.

It is still a further object of the present invention to provide a compact fluidized bed heat exchanger, which has a high mixing rate of particulate material and a reliable material circulation/return system.

It is still a further object of the present invention to provide a compact fluidized bed heat exchanger, which has a self-adjusting bed level control.

It is still a further object of the present invention to provide a compact fluidized bed heat exchanger which has a compact and efficiently supported partition wall with a main reactor.

For meeting these and other objects of the invention, the circulating fluidized bed reactor of the present invention according to its first aspect includes substantially vertical walls with cooling elements, the walls defining the interior of the reactor chamber; means for introducing fluidization gas at the bottom of the fluidized bed reactor; means for introducing particulate material into said reactor; separator for separating particulate material from the gases, said separator being in connection with said reactor at the upper section thereof; return duct connected to the separator; a bubbling fluidized bed adjacent to the reactor and provided with heat exchanger means for cooling particulate material, side walls, and rear and front walls having cooling elements in fluid communication with the cooling elements of the reactor, said bubbling fluidized bed being connected to said return duct, and the circulating fluidized bed comprising a solid tight discharge channel, i.e. a channel disabling movement of particulate material through its walls, between said heat exchanger means and the rear wall, for discharging material from the bubbling fluidized bed to the reactor, and a lower opening section in said discharge channel for allowing particulate material to come from the bottom section of the bubbling fluidized bed and enter the lower section of the discharge channel, the upper opening section in said discharge channel allowing particulate material to be discharged from the upper section of the discharge channel into the reactor.

Preferably the particulate material in said discharge channel is maintained at a fluidized state so that it is in a flowable form and readily controllable. There may be independently controllable fluidization gas introduction means for both the discharge channel and the bubbling fluidized bed. According to the invention, the particulate material is directed from above the bubbling fluidized bed to its reactor side half. The introduced particulate material may be hot solids directly from the circulating fluidized bed or from the separator which separates solids from the reactor exhaust gases.

According to a preferred embodiment of the present invention, the lower opening of the discharge channel is located vertically below the upper portion of the heat exchanger and the upper opening of the discharge channel is above the lower portion of the heat exchanger, so that at least a portion of the heat exchanger is immersed in the bubbling fluidized bed. According to the invention, the discharge channel consists of several distinct, individual small channels for creating the required cross-sectional area on the first hand, and a robust, cooled structure on the other. The cross section of the individual channel is preferably rectangular, but naturally this may be arranged also in a different manner, still gaining at least some of the advantages of the present invention. The discharge channel or several channels are preferably so dimensioned as to have an areal cross section <30%, preferably <20% of the cross section of the bubbling fluidized bed.

According to another aspect of the present invention, the circulating fluidized bed reactor with substantially vertical walls with cooling elements therein, the vertical walls defining the interior of the reactor chamber, includes means for introducing fluidization gas at the bottom of the fluidized bed reactor; means for introducing particulate material including fuel into said reactor; separator for separating particulate material from the gases, said separator being in connection with said reactor at the upper section thereof; bubbling fluidized bed provided with a heat exchanger for cooling particulate material, said bubbling fluidized bed having side walls and a rear wall having cooling elements in fluid communication with the cooling elements of the reactor, a front wall structure partitioning the bubbling fluidized bed and the circulating fluidized bed from each other, the front wall consisting essentially of substantially vertical tubes being formed in a manner to provide at least one discharge channel within said wall structure including at least one substantially vertical solid tight portion, i.e, a portion substantially disabling penetration of particulate material through it, for transferring particulate material, said discharge channel being capable of discharging solids from the lower section of said bubbling fluidized bed and introducing the same into the circulating fluidized bed. Advantageously the discharge channel comprises an opening from the lower section of the discharge channel to the lower section of said bubbling fluidized bed, i.e, a lower opening, and an opening from the upper section of the discharge channel to the reactor, i.e, an upper opening. Also it is preferred to arrange the lower opening below the upper portion of the heat exchanger, and the upper opening is above the lower portion of the heat exchanger to ensure that at least a portion of the heat exchanger is immersed in the bubbling bed. The discharge channel is preferably formed in the wall by bending the tubes away from the discharge channel area and turning them behind the tube adjacent to or outside said area.

A method of operating a circulating fluidized bed reactor is provided according to the present invention, in connection with a circulating fluidized bed reactor having substantially vertical walls with cooling elements therein, said vertical walls defining the interior of the reactor chamber; means for introducing fluidization gas at the bottom of the fluidized bed reactor; means for introducing particulate material into said reactor; separator for separating particulate material from gases, said separator being in connection with said reactor at the upper section thereof; bubbling fluidized bed adjacent to the reactor and being provided with heat exchanger means for cooling particulate material, side walls, and rear and front walls having cooling elements in fluid communication with the cooling elements of the reactor, a discharge channel between said heat exchanger and rear wall; the method comprising the steps of maintaining a circulating fluidized bed in the reactor by providing entrainment of substantial amount of particulate material from the reactor to the separator, separating particulate material from the gas in the separator and returning the separated material back to the reactor; introducing particulate material into the bubbling fluidized bed above the upper surface of the fluidized bed therein; fluidizing the particulate material in the bubbling fluidized bed and recovering heat from the fluidized particulate material by said heat exchanger; discharging cooled particulate material from said bubbling fluidized bed at the lower section thereof into the lower section of the discharge channel; fluidizing said discharged particulate material in said discharge channel and introducing particulate material from the upper section of said discharge channel into the reactor. Advantageously the upper surface of the bubbling fluidized bed is maintained at least on the same vertical level as the particulate material is introduced from the upper section of said discharge channel into the reactor.

BRIEF DESCRIPTION OF THE DRAWINGS

The above description as well as further objects, features and advantages of the present invention will be more fully appreciated by reference to the following detailed description of the presently preferred, but nonetheless illustrative embodiments in accordance with the present invention when taken in conjunction with the accompanying drawings wherein.

DETAILED DESCRIPTION OF DRAWINGS

Figure 1:
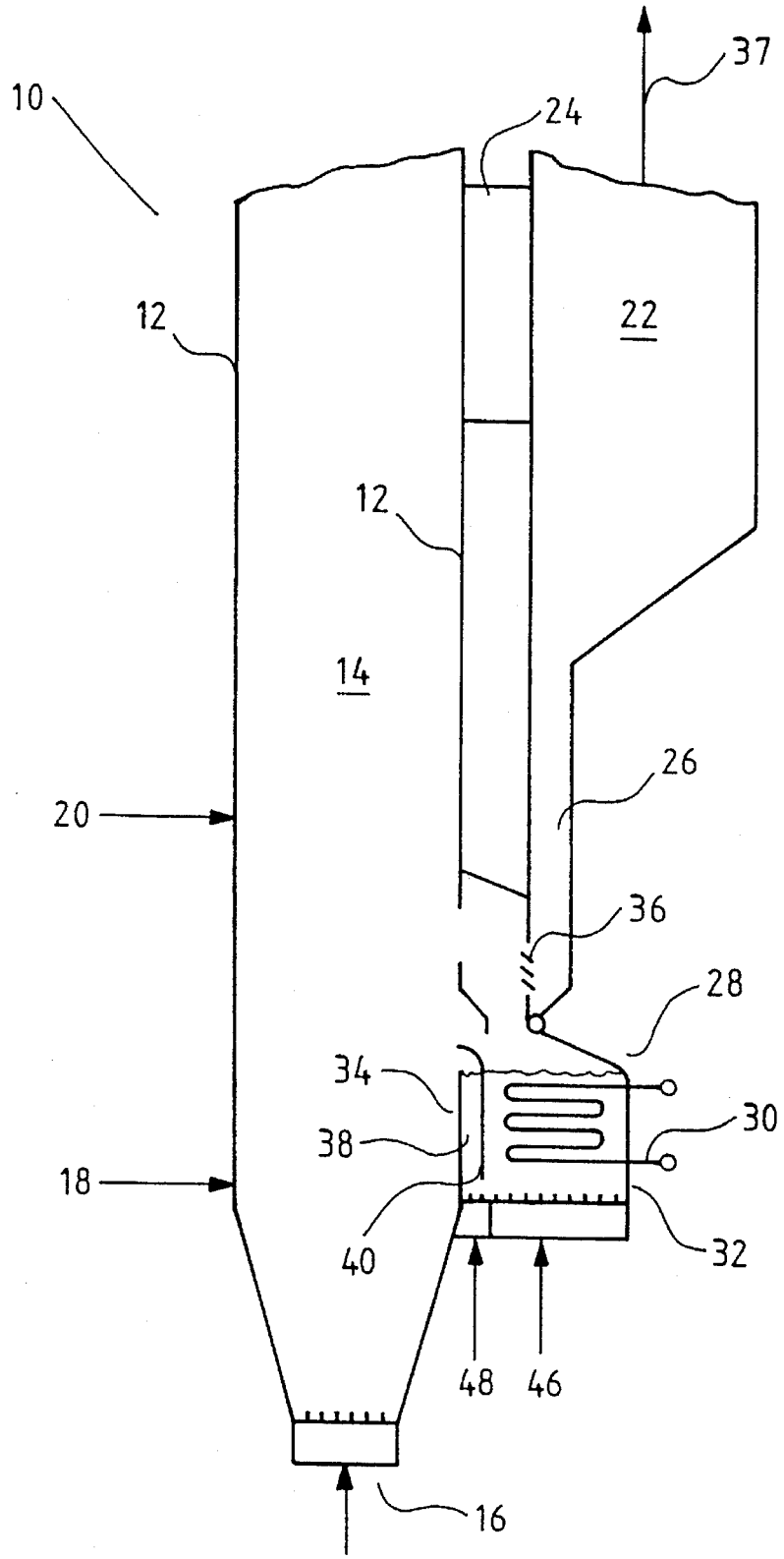
FIG. 1 is an illustration of a circulating fluidized bed reactor with a bubbling fluidized bed according to the invention.

In FIG. 1, there is depicted a circulating fluidized bed reactor 10. The circulating fluidized bed reactor is formed of substantially vertical walls 12 with cooling elements therein. Conventionally the walls are made of adjacent parallel tubes connected to each other with fin or bar elements to form a gas tight structure. This is well known in the art and is therefore not explained here more in detail. The walls 12 define the interior of the reactor chamber 14. In the bottom section of the reactor there are means 16 for introducing fluidization gas, such as air, into the bottom of the fluidized bed reactor. Also means 18 for introducing particulate material into said reactor are provided. At the upper elevation, there are means for introducing secondary air 20, (that is at least when combustion of fuel is practised in the reactor). A separator 22 for separating particulate material from the gases is connected with said reactor at the upper section thereof by means of a duct 24. In some cases, the separator may also be in a direct back-to-back relation with the reactor rear wall 12. Preferably the separator is a cyclone separator, which may be arranged either in a vertical or a horizontal position. A return duct 26 connects the particulate material outlet of separator 22 with the reactor to recirculate particulate material separated in the separator back to the circulating fluidized bed reactor chamber 14. In connection with the return duct 26, there is provided a bubbling fluidized bed chamber 28 adjacent to the reactor 14 provided with heat exchanger means 30 for cooling particulate material fluidized therein. The bubbling fluidized bed chamber 28 has side walls (not shown herein), and rear 32 and front 34 walls having cooling elements in fluid communication with the cooling elements of the reactor walls 12. The bubbling fluidized bed chamber 28 is connected with said return duct for receiving particulate material separated from the gases. The gases are discharged from the separator 22 via outlet 37 for further processing such as heat recovery.

When operating as a combustor/steam generator, the circulating fluidized bed is formed in the chamber 14 in a conventional manner. A characteristic feature of the circulating fluidized bed is that particulate material is entrained with the gases flowing upwards in the chamber to such an extent that either new material must be introduced into the bed or separation and recirculation of the entrained material must take place, the latter being a preferred manner of maintaining the circulating fluidized bed. Naturally any discharge or material escaping through the separator must be compensated by bringing new material into the circulation process.

Figure 2:
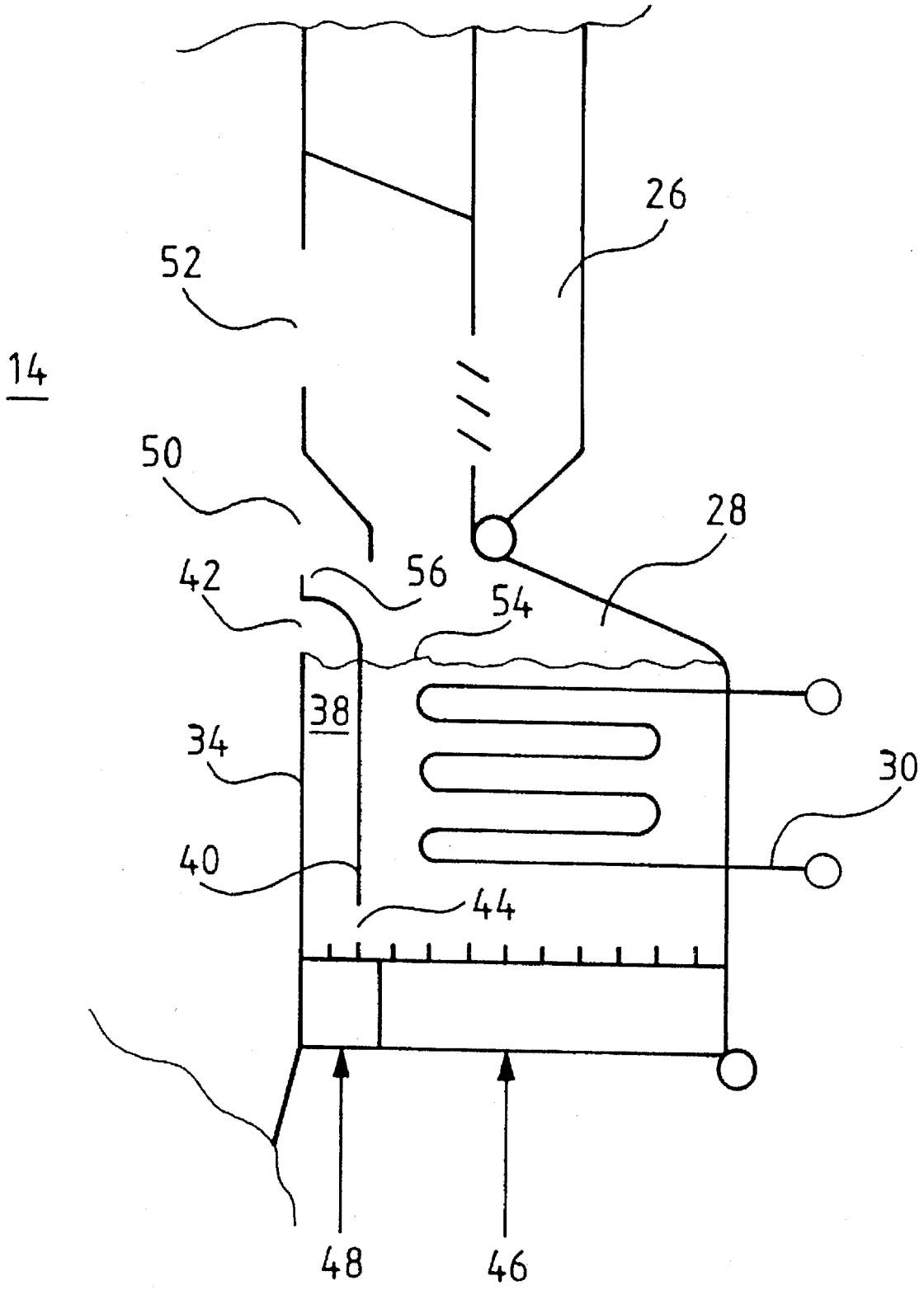
FIG. 2 shows an enlargement of the bubbling fluidized bed of FIG. 1.

The separated particulate material is conveyed from the lower part of the return duct 26 via a gas lock 36 into the chamber 28. Particulate material is preferably introduced into the chamber 28 from above the surface of the bubbling bed therein and to the reactor side half of the bubbling bed from the gas lock 36. As the particulate material is introduced relatively near the common wall between the reactor and the chamber 28, which is advantageous when aiming at a compact structure, the bubbling fluidized bed chamber is constructed to operate in connection with such an arrangement advantageously as described below with reference to FIG. 2.

The rear wall section 34 partitioning the reactor 14 and the bubbling bed chamber 28 includes a discharge channel 38, which is formed by inner 40 and outer sections of the wall 34. The discharge channel 38 is formed in a manner which substantially prevents the movement of particulate material in the bubbling fluidized bed through it. However, it may also allow passage of gas at least to some extent. The discharge channel is provided with an opening section 42 at its upper section to allow communication between the discharge channel and the reactor 14. The discharge channel is also provided with an opening section 44 to allow communication between the discharge channel and the bubbling fluidized bed chamber 28, the opening 44 being located at the lower portion of the discharge channel.

In normal operation of the circulating fluidized bed reactor, hot particulate material is separated from the exhaust gases. At least part of the separated particulate material is introduced from the return duct 26 to the bubbling fluidized bed chamber 28 at its reactor side half. And, since the opening section 42 is located near the introduction area of the particulate material, i.e., reactor side half of the chamber 28, the inner wall section 40 is according to the invention formed to disable movement of particulate material through it to prevent a direct flow of material to the outlet opening section 42, i.e., preventing formation of a short circuit. In this manner, the particulate material advantageously introduced into the bubbling fluidized bed chamber 28 at its reactor side half, above the bed surface, is forced to mix efficiently while being fluidized by means 46. The particulate material cooled by heat exchanger 30 is discharged via opening section 44 in order to ensure efficient operation. The particulate material is discharged at the opposite side of the bed compared with where it is introduced. The discharged material is fluidized in the discharge channel 38 by introducing independently controllable fluidization gas by means 48. The fluidization gas may by conveyed into the reactor 14 via opening sections 50 and/or 52. The heat exchanger may be, for example, a superheater of steam formed in the cooling elements of the reactor, i.e., an evaporating tube wall. It is also possible to arrange intermediate steam reheat surfaces in such a bubbling fluidized bed.

An advantageous aspect of the present invention is that the bubbling fluidized bed chamber 28 and its heat exchanger may be designed for a certain performance, without a need of being capable of processing all the particulate material separated by the separator 22. In certain operating circumstances or in case the bubbling fluidized bed chamber and the heat exchanger are designed for a heat transfer load, which is considerably smaller than obtained within the medium capacity of the introduced solids, the present invention enables the equipment size (capacity) to be designed in a sophisticated manner to the required dimensions. In operation, the fluidization means 48, 46 are controlled, e.g., according to a required heat output of the heat exchanger. This fluidization controls the discharge of the particulate material via the discharge channel 38 and thus the heat output of the heat exchanger 30. If the amount of introduced material from, e.g., gas lock 36 (material may also be conveyed directly from the reactor 14 via opening section 50 and/or 52, which is explained later) is greater than that needed for gaining the required heat output from heat exchanger 30, the bed level 54 is allowed to rise up to the level of edge 56 of the opening section 50. This means that all surplus of hot particulate material not required for gaining the desired heat output of the heat exchanger 30 is allowed to flow directly and uncooled into the reactor 14. In such a condition the particulate tread of the surplus of particles is merely "surface circulation" without any substantial mixing of material. This sophisticated arrangement concerns maintaining the required circulating bed inventory in the reactor 14 without a need to ineffectively design the bubbling fluidized bed 28 to be able to process all material needed for the circulating fluidized bed, even if the heat output of the heat exchanger 30 would not require that. The above-mentioned solution results, e.g., in a smaller (more compact) size of the bubbling fluidized bed and the discharge channel since there is no need to dimension the bubbling fluidized bed and related equipment for full load operation of the circulating fluidized bed reactor when the particle circulation is at its maximum. Moreover, in order to avoid the impact of an upward flow of fluidization gas from the bubbling bed chamber into the reactor and of a downward flow of particulate material fed into the bubbling bed chamber, it is advantageous to arrange opening sections respectively in horizontally spaced relations.

Figure 3:
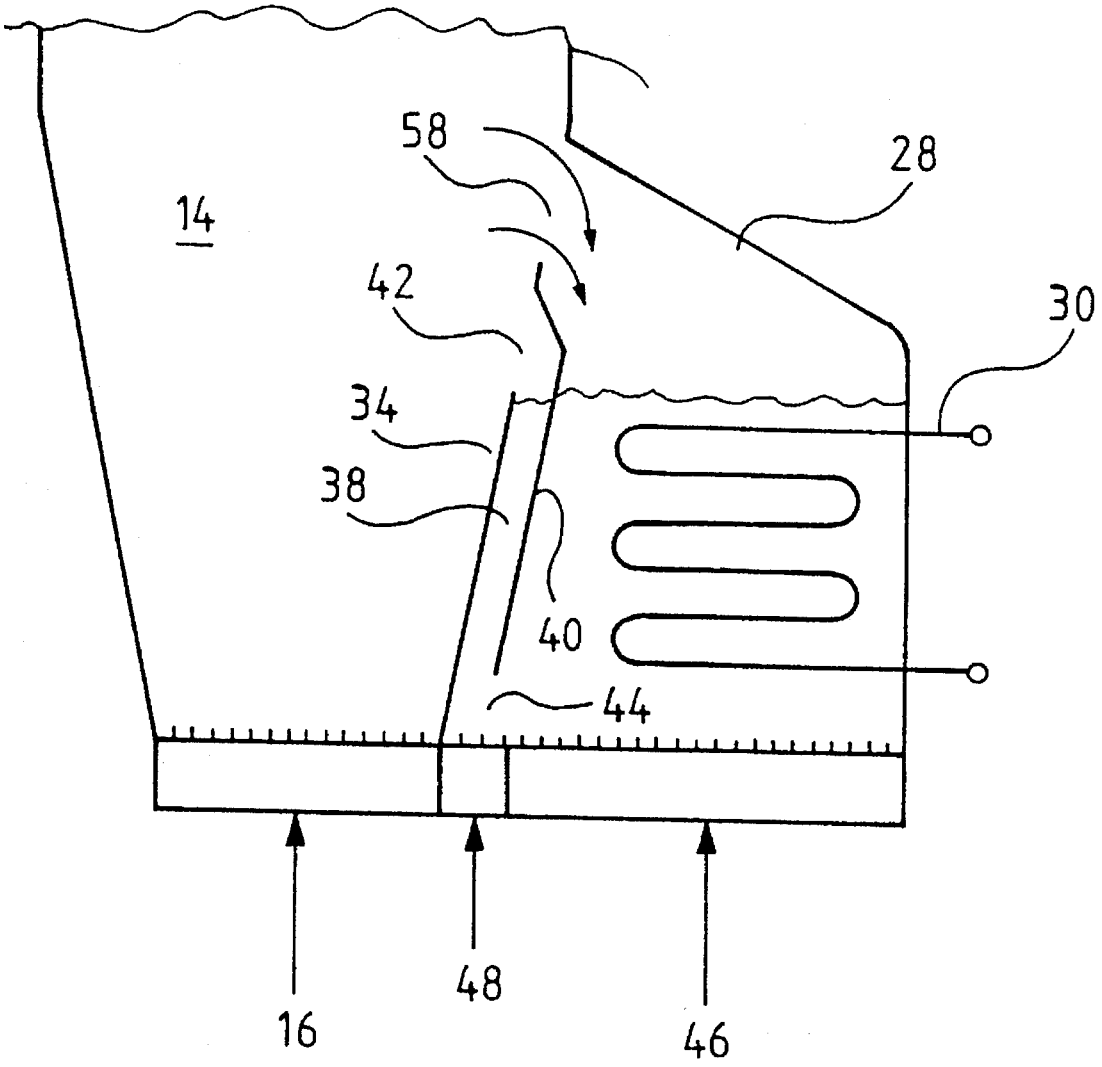
FIG. 3 is an illustration of the lower section of a circulating fluidized bed reactor with another embodiment of the bubbling fluidized bed according to the invention.

In FIG. 3, there is shown an arrangement to process (e.g. cool) particulate material of a circulating fluidized bed reactor 14 in a direct communication with the circulating fluidized bed. The material is fed directly from the reactor 14 via an opening section 58 in this embodiment, whereas in FIGS. 1 and 2 this feature is possible to combine with the feeding of material from the separator 22. The bubbling fluidized bed 28 is arranged at the lower section of the circulating fluidized bed reactor 14 and they have a common wall 34. The lower section is only shown in FIG. 3, but it should be understood that the whole reactor 14 may be, e.g., as shown in FIG. 1. There may also be several distinct bubbling fluidized beds 28 at different vertical elevations and sides of the reactor 14. This is advantageous due to the fact that the bubbling fluidized bed is preferably designed only for particulate handling capacity required by desired heat output of the heat exchanger 30. And, due to the nature of circulating fluidized bed, it is possible to select the rate of introduction of particulate material into each bubbling fluidized bed, e.g., by positioning each at such vertical elevation which provides a rate of material introduction which corresponds with the desired heat output of the heat exchanger at respective load of the circulating fluidized bed reactor. This is possible because the entrainment of particulate material in the circulating fluidized bed is a function of the load of the reactor.

In operation of the circulating fluidized bed reactor as illustrated in FIG. 3, there is utilized the fact that even at low loads of the circulating fluidized bed 14 there is available particulate material flowing into the bubbling fluidized bed 28 at the lower section of the reactor 14. Particulate material is flowing into the bubbling fluidized bed chamber 23 via opening 58. The material is mostly introduced into the reactor side half of the bubbling bed chamber. In order to prevent short circuit, the inner wall section 40 is according to the invention formed to disable movement of particulate material through it to prevent direct flow of material to the outlet opening section 42 of the discharge channel. In this manner, the particulate material introduced into the bubbling fluidized bed chamber 28 mostly at its reactor side half, above the bed surface, is forced to mix efficiently while being fluidized by means 46. Particulate material cooled by heat exchanger 30 is discharged via the opening section 44 in order to ensure efficient operation. Particulate material is discharged at the opposite side of the bed compared to where it is introduced. The discharged material is fluidized in the discharge channel 38 by introducing independently controllable fluidization gas by means 48. The fluidization gas may by discharged into the reactor 14 via opening sections 58.

Figure 4:
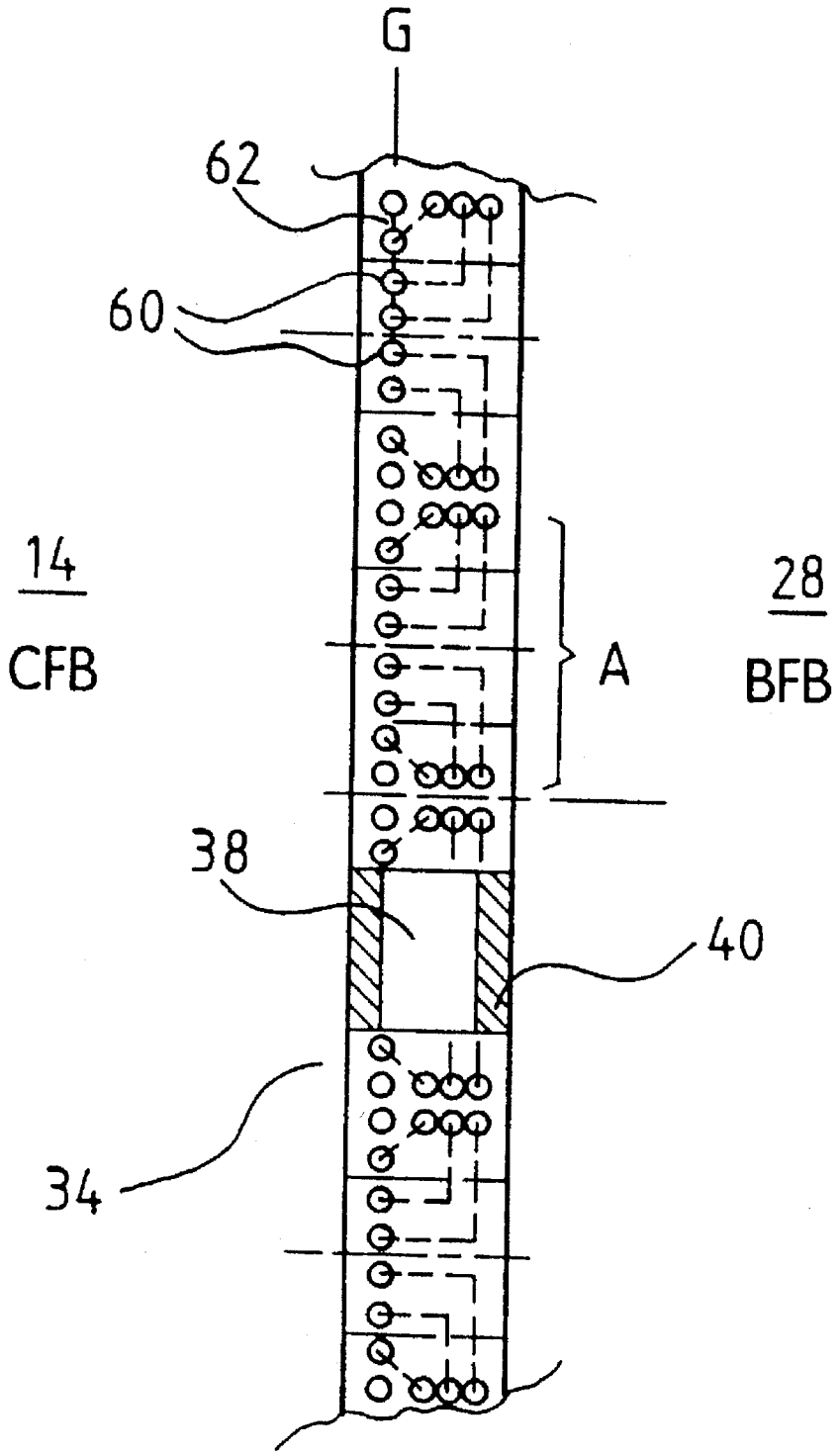
FIG. 4 is an illustration of a partition wall section between the circulating fluidized bed reactor and the bubbling fluidized bed according to the invention.

The partition wall 34 is preferably formed so as to be integrated with the flow circuitry of the walls of the reactor 14, meaning that, in the most preferred embodiment, the wall 34 is formed by arranging the tubes, fins and lining of the wall 34 of the circulating fluidized bed reactor adjacent to the bubbling fluidized bed in such manner that the discharge channel is formed in connection with the wall 34. Since in operating conditions, there are various factors causing stress to the wall structure, the wall 34 is arranged to be durable against, e.g., vibrations by being constructed as an integrated member of the reactor 14. This feature also eliminates all undesired thermal expansion differences between the reactor 14 and the bubbling fluidized bed chamber 28. In FIG. 4, there is illustrated a preferred embodiment of the wall 34 partitioning the circulating fluidized bed 14 and the bubbling fluidized bed chamber 28. The wall includes a plurality of tubes 60 forming a part of the cooling system of the reactor 14. Typically the cooling system is a steam generation system. The tubes 60 are connected to each other, e.g., by fins or bars 62 between the tubes to form a substantially gas tight wall structure. At a certain spacing the tubes are bent away from general plain "G" so that there are formed areas or widths "A" free of tubes. According to the invention it is possible to arrange in such an area the discharge channel(s) 38 by forming inner 40 and outer wall sections so that direct flowing of particulate material is prevented through the area or width A free of tubes. The area or width "A" is typically 0<"A"<1 m, preferably 10 cm<"A"<50 cm. The inner and outer wall sections are preferably of suitable lining material which endures the circumstances in the reactor such as refractory castable coating. In FIG. 4, the illustration is a view of FIG. 3, i.e., the wall at a location where the discharge channel is a substantially closed channel. As can bee seen, the discharge channel preferably has a rectangular cross section. Naturally it could be also designed differently.

Figure 5:
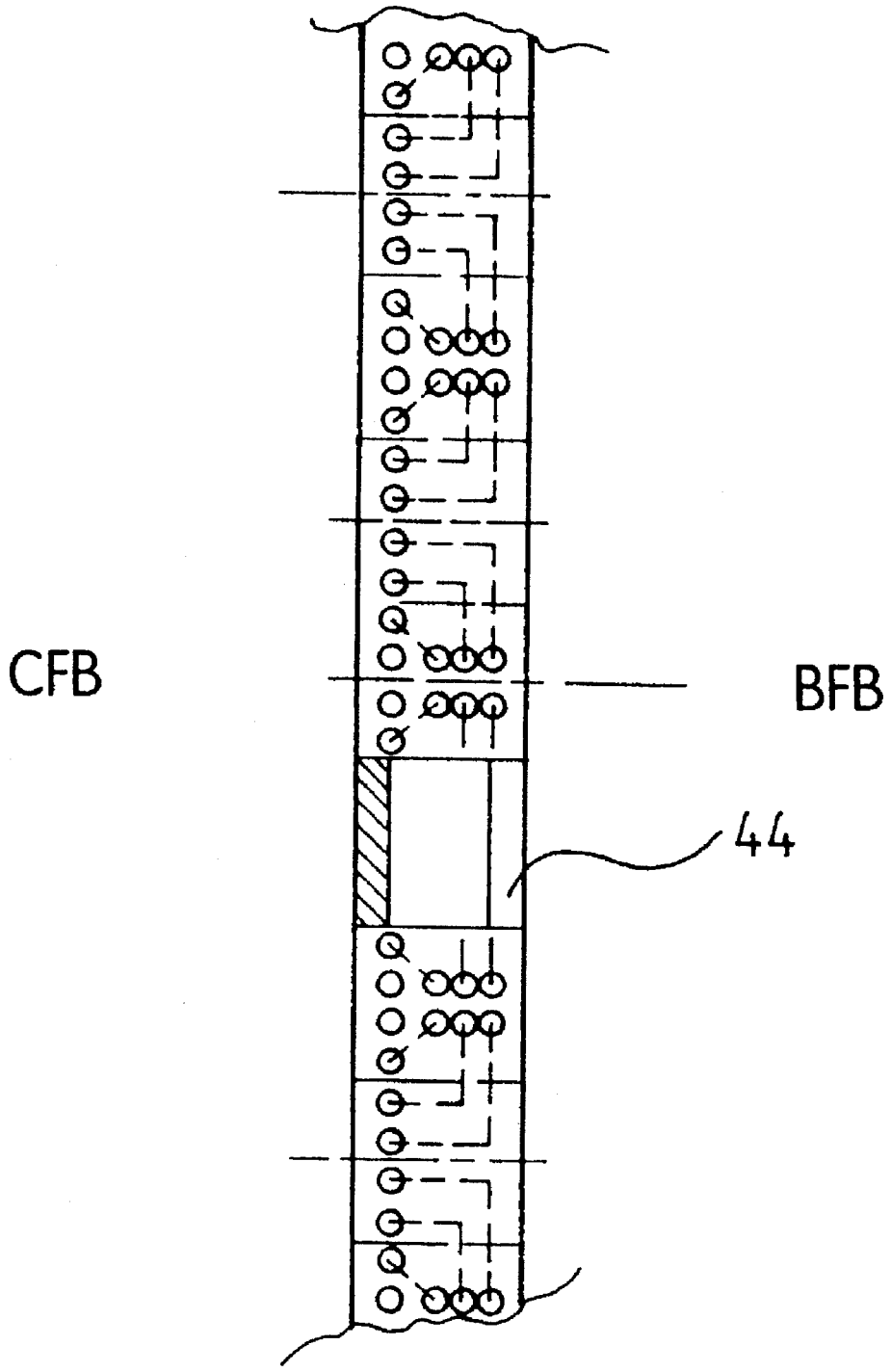
FIG. 5 is an illustration of the lower section of the partition wall section of FIG. 4.
Figure 6:
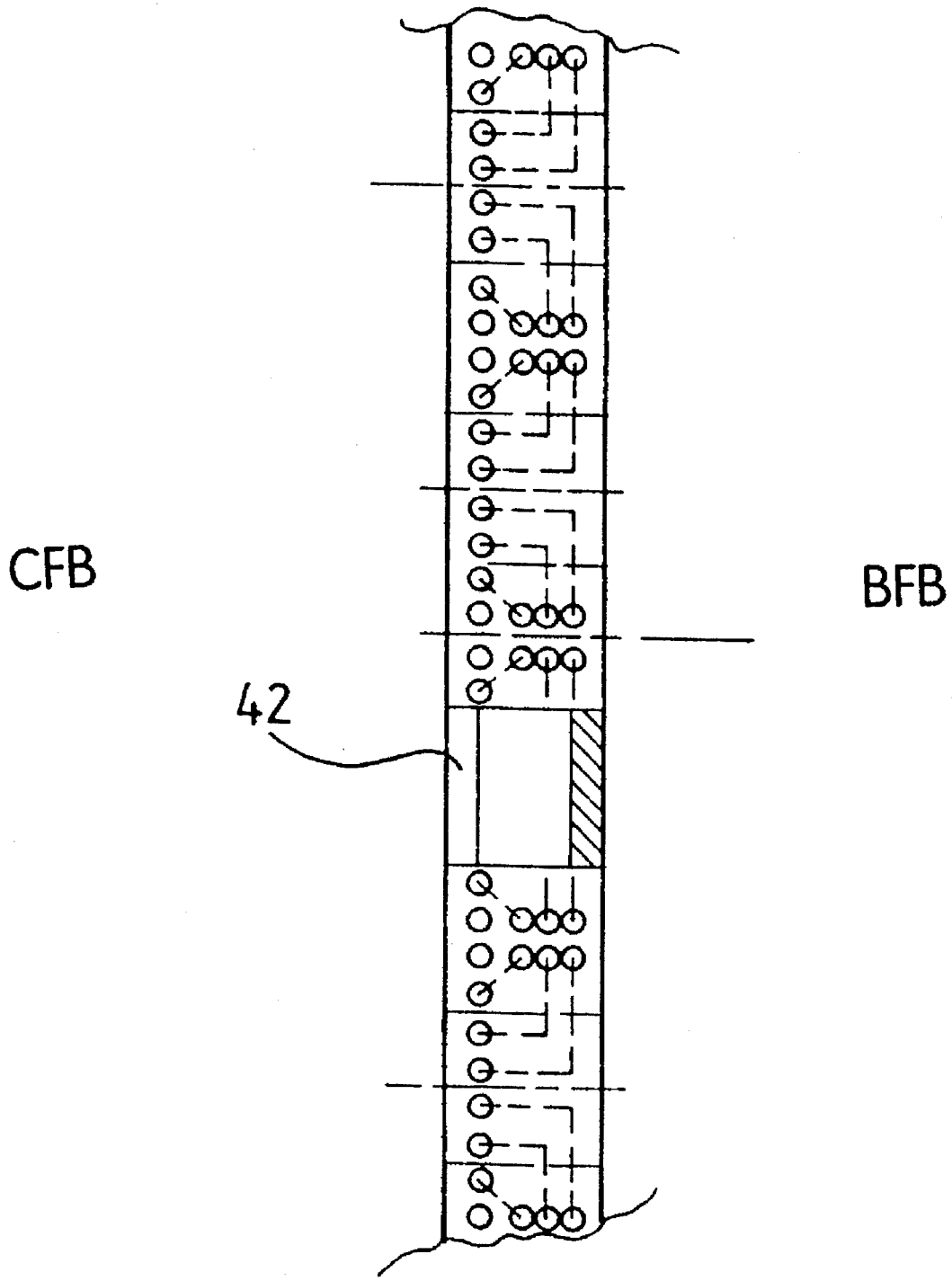
FIG. 6 is an illustration of the upper section of the partition wall section of FIG. 4.
Figure 7:
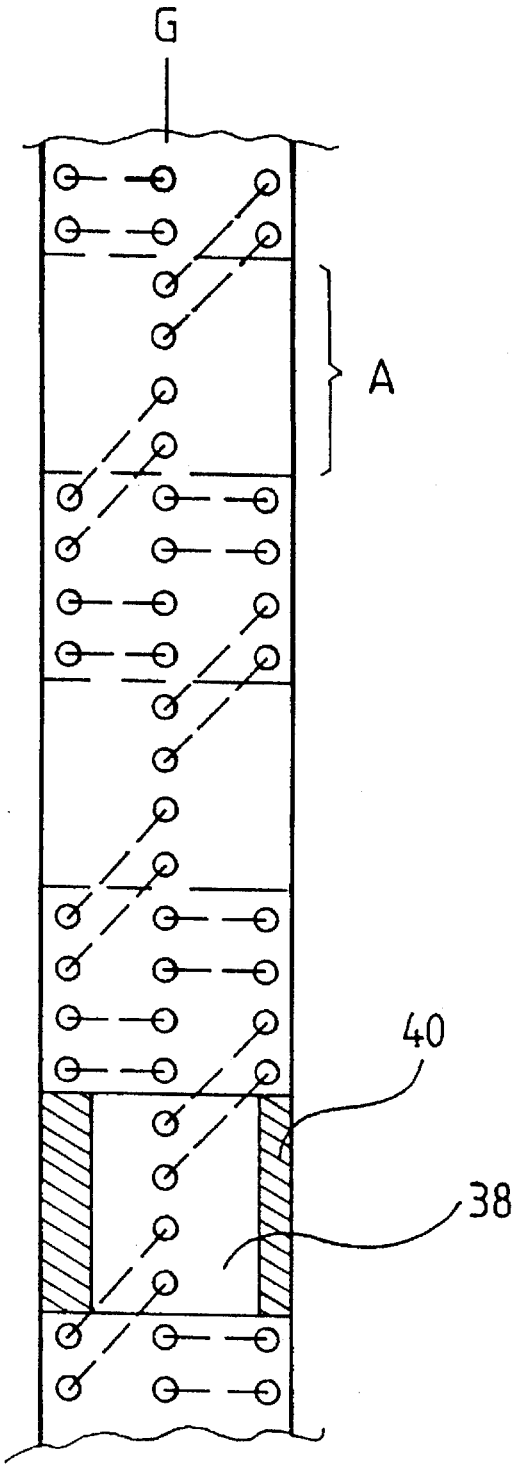
FIG. 7 is another illustration of the partition wall section of FIG. 4.

FIGS. 5 and 6 show that the openings 42 and 44 may be established simply by arranging an opening in the lining material of the discharge channel. FIG. 7 shows another possibility of bending the tube from plain "G" to both sides leaving areas "A" free of tubes for the discharge channel 38. Naturally, there are various possibilities to arrange the tubing at wall section 34, also so that there are tubes inside the wall section 40 to stiffen it. E.g, by bending the tubes appropriately, it is possible to obtain also lateral movement of solids when they are being transported by the discharge channel.

The present invention may be applied to different processes in connection with circulating fluidized bed reactors, such as for cooling or generally for treating of gas by using a circulating fluidized bed reactor. Also, e.g., combustion and gasification processes at pressures above atmospheric may be considered to be run with the system disclosed herein, in which case the reactor should be enclosed by a pressure vessel.

While various embodiments of the invention and suggested modifications thereto have been described, it should be understood that modifications could be made in the structure and arrangement of the described embodiments without departing from the scope of the invention which is more defined in the following claims.

What is claimed is:

1. A circulating fluidized bed reactor comprising: a plurality of substantially vertical walls with cooling elements therein, said vertical walls including a rear wall, and defining an interior of a circulating fluidized bed reactor chamber; means for introducing fluidization gas at the bottom of said fluidized bed reactor chamber; means for introducing particulate material into said reactor chamber; a separator for separating particulate material from exhaust gases, said separator connected to an upper section of said reactor chamber; a return duct connected to said separator; a bubbling fluidized bed adjacent to said reactor chamber rear wall and including a heat exchanger for cooling particulate material, and including fluidizing means; a solids-tight discharge channel between said bubbling fluidized bed and said rear wall, said channel for discharging material from the bubbling fluidized bed to said reactor chamber; means for introducing particulate material into the bubbling bed at an upper section thereof; an opening in a lower section in said discharge channel for allowing particulate material to flow from a bottom section of the bubbling fluidized bed into said opening of said lower section of said discharge channel; and an opening in an upper section in said discharge channel allowing particulate material to be discharged from said upper section of said discharge channel into said reactor chamber.

2. A circulating fluidized bed reactor according to claim 1, further comprising means for fluidizing particulate material in said discharge channel.

3. A circulating fluidized bed reactor according to claim 2 wherein said discharge channel fluidizing means is controlled separately and distinctly from said fluidizing means for said bubbling bed.

4. A circulating fluidized bed reactor according to claim 1 further comprising means for directing fluidizing gas of the bubbling fluidized bed into said circulating fluidized bed reactor chamber.

5. A circulating fluidized bed reactor according to claim 1, further comprising a reactor wall portion in common with the bubbling fluidized bed above said discharge channel, and including at least one opening for feeding hot particulate material from said reactor chamber into the bubbling fluidized bed.

6. A circulating fluidized bed reactor according to claim 1, wherein said bubbling fluidized bed is connected with said return duct, and further comprises means for introducing particulate material separated in said separator into the bubbling fluidized bed, above the bubbling fluidized bed.

7. A circulating fluidized bed reactor according to claim 1, wherein said lower opening is below an upper portion of said heat exchanger.

8. A circulating fluidized bed reactor according to claim 1, wherein said upper opening is above a lower portion of said heat exchanger.

9. A circulating fluidized bed reactor according to claim 1, wherein said discharge channel has a cross sectional area that is <20% of the cross sectional area of the bubbling fluidized bed.

10. A circulating fluidized bed reactor according to claim 1, wherein the discharge channel consists of a plurality of distinct, individual small channels.

11. A circulating fluidized bed reactor according to claim 10, wherein at least some of said individual small channels have a rectangular cross section.

12. A circulating fluidized bed reactor according to claim 6, wherein said means for introducing particulate material separated by said separator into the bubbling fluidized bed comprises a return duct having an opening for introducing particulate material into the bubbling fluidized bed, said opening disposed adjacent said reactor chamber.

13. A circulating fluidized bed reactor comprising: a plurality of substantially vertical walls with cooling elements therein, said vertical walls including a rear wall, and defining an interior of a circulating fluidized bed reactor chamber; means for introducing fluidization gas at the bottom of said fluidized bed reactor chamber; means for introducing particulate material into said reactor chamber; a separator for separating particulate material from exhaust gases, said separator connected to an upper section of said reactor chamber; a return duct connected to said separator; a bubbling fluidized bed adjacent to said reactor chamber rear wall and including a heat exchanger for cooling particulate material, and including fluidizing means; said bubbling fluidized bed comprising:

a plurality of side walls and a rear wall having cooling elements in fluid communication with said cooling elements of said reactor walls; and a front wall structure partitioning the bubbling fluidized bed and the circulating fluidized bed from each other, said front wall consisting essentially of a plurality of substantially vertical tubes providing at least one discharge channel within said wall structure including at least one substantially vertical solid tight portion for transferring particulate material, said discharge channel being capable of discharging solids from a lower section of said bubbling fluidized bed and introducing the discharged solids into the circulating fluidized bed.

14. A circulating fluidized bed reactor according to claim 13 wherein said discharge channel comprises a lower opening from said lower section of said discharge channel to a lower section of the bubbling fluidized bed, and an upper opening from an upper section of said discharge channel to said reactor chamber.

15. A circulating fluidized bed reactor according to claim 14, wherein said lower opening is below an upper portion of said heat exchanger.

16. A circulating fluidized bed reactor according to claim 14, wherein said upper opening is above a lower portion of said heat exchanger.

17. A circulating fluidized bed reactor according to claim 13, wherein said discharge channel is formed into wall areas in which tubes are bent to form an area free of tubes by lining said wall areas with refractory castable coating.

18. A circulating fluidized bed reactor according to claim 13, wherein said discharge channel is formed in a wall by bending tubes away from said discharge channel, and turning the bent away tubes behind a tube adjacent to or outside of said area.

19. A method of operating a circulating fluidized bed reactor having substantially vertical walls with cooling elements therein, the vertical walls defining an interior of the reactor chamber; a bubbling fluidized bed adjacent to the reactor, provided with a heat exchanger for cooling particulate materials; and a discharge channel between the heat exchanger and the reactor chamber; said method comprising the steps of:

introducing fluidization gas at the bottom of the fluidized bed reactor;

introducing particulate material into the reactor chamber;

separating particulate material from exhaust gases from the chamber, maintaining a circulating fluidized bed in the reactor chamber to provide entrainment of a substantial amount of particulate material from the reactor chamber;

returning the separated material back to the reactor chamber;

introducing particulate material into the bubbling fluidized bed above the upper surface of the fluidized bed therein;

fluidizing the particulate material in the bubbling fluidized bed and recovering heat from the fluidized particulate material with the heat exchanger;

discharging cooled particulate material from the bubbling fluidized bed at a lower section thereof into the lower section of the discharge channel; and fluidizing the discharged particulate material in the discharge channel and introducing particulate material from the upper section of the discharge channel into the reactor chamber.

20. A method according to claim 19, comprising the further step of maintaining the upper surface of the bubbling fluidized bed at least on the same vertical level as the particulate material that is fed from the upper section of the discharge channel into the reactor chamber.

* * * * *